US006220372B1

(12) United States Patent
Cherry

(10) Patent No.: US 6,220,372 B1
(45) **Date of Patent: *Apr. 24, 2001**

(54) APPARATUS FOR DRILLING LATERAL DRAINHOLES FROM A WELLBORE

(75) Inventor: Donald Earl Cherry, Calgary (CA)

(73) Assignee: Wenzel Downhole Tools, Ltd., Calgary (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/985,085

(22) Filed: Dec. 4, 1997

(51) Int. Cl.[7] ..... E21B 7/06; E21B 7/08

(52) U.S. Cl. ..... 175/81; 175/79; 175/320; 175/323; 166/117.5; 464/52; 464/58

(58) Field of Search ..... 166/242.2, 298, 166/50, 117.6, 117.5; 175/80, 81, 320, 75, 79, 323; 138/122, 129; 464/52, 57, 58, 178, 183

(56) References Cited

U.S. PATENT DOCUMENTS

| | | | | |
|---|---|---|---|---|
| 1,429,146 | | 9/1922 | Karge . | |
| 1,481,078 | * | 1/1924 | Albertson | 464/52 |
| 1,804,819 | * | 5/1931 | Spencer, Jr. et al. | 175/81 |

(List continued on next page.)

FOREIGN PATENT DOCUMENTS 1061772 9/1979 (CA) .

1154429 9/1983 (CA) .

OTHER PUBLICATIONS

Lance Penetrator Brochure, Grant McQueen, undated.
TIW Ultra Short Radius (USR) Horizontal Drilling System Brochure; TIW Corporation; Houston, Texas, undated.
Society of Petroleum Engineers SPE 13949 "Horizontal Radial Drilling System" W. Dickson and R.W. Dickinson, Petrol Physics LTD., Mar. 1985.

*Primary Examiner*—David Bagnell
*Assistant Examiner*—Sunil Singh
(74) *Attorney, Agent, or Firm*—Millen, White, Zelano & Branigan, P.C.

(57) ABSTRACT

Apparatus for drilling lateral drainholes from a well casing comprises a flexible shaft having a bit at the lower end; the shaft extending through a shaft guide conduit anchored within the casing adjacent an oil-bearing formation. The "L" shaped guide conduit re-directs the shaft from an path parallel to the casing, through an elbow, to a path substantially perpendicular to the casing. The flexible shaft is formed of a helically wound outer coil spring and one or more helically wound and smaller inner coil springs residing concentrically therein. Each coil spring is closely fitted within the other. Each coil spring is wound opposite in direction to that of the next adjacent coil spring so as to interfere when under torsion. Bushings are located within the elbow for causing the shaft to flex and turn while permitting rotation and axial movement therethrough. A motor imparts torque into the top of the shaft, preferably through an intermediate driveshaft. The shaft is movable up and down within the casing. Accordingly, when the motor is rotating the bit, and the shaft is lowered, the shaft guide conduit supports the shaft, guides it through the elbow and directs the bit against the casing for cutting through the casing and then into the formation.

14 Claims, 2 Drawing Sheets

U.S. PATENT DOCUMENTS

| | | | | |
|---|---|---|---|---|
| 2,198,016 | * | 4/1940 | Rogers et al. | 175/82 |
| 2,390,646 | | 12/1945 | Hays . | |
| 2,441,881 | | 5/1948 | Hays . | |
| 2,709,070 | * | 5/1955 | Bielstein | 464/19 |
| 2,852,230 | | 9/1958 | Garrison . | |
| 2,906,499 | | 9/1959 | Travis . | |
| 3,011,568 | * | 12/1961 | Grimm | 175/74 |
| 3,234,723 | * | 2/1966 | Brown | 57/222 |
| 3,838,736 | * | 10/1974 | Driver | 166/299 |
| 4,007,797 | * | 2/1977 | Jeter | 175/26 |
| 4,051,908 | * | 10/1977 | Driver | 175/78 |
| 4,057,115 | * | 11/1977 | Blanz | 173/160 |
| 4,058,176 | | 11/1977 | Fischer . | |
| 4,266,619 | * | 5/1981 | Bodine | 175/55 |
| 4,290,494 | | 9/1981 | Blanz . | |
| 4,424,045 | * | 1/1984 | Kulischenko et al. | 464/52 |
| 4,476,945 | | 10/1984 | Hearn . | |
| 4,497,381 | | 2/1985 | Dickinson, III et al. . | |
| 4,658,916 | * | 4/1987 | Bond | 175/81 |
| 4,762,186 | | 8/1988 | Dech . | |
| 4,964,474 | | 10/1990 | Poesch . | |
| 5,052,404 | | 10/1991 | Hodgson . | |
| 5,085,283 | * | 2/1992 | Seabourn et al. | 175/61 |
| 5,148,877 | | 9/1992 | MacGregor . | |
| 5,165,421 | * | 11/1992 | Fleischhacker et al. | 464/58 X |
| 5,197,783 | | 3/1993 | Theimer . | |
| 5,392,858 | | 2/1995 | Peters . | |
| 5,439,066 | * | 8/1995 | Gipson | 175/61 |
| 5,485,889 | | 1/1996 | Gray . | |
| 5,562,275 | | 10/1996 | Weissenfluh et al. . | |
| 5,738,178 | * | 4/1998 | Williams et al. | 175/61 |

* cited by examiner

APPARATUS FOR DRILLING LATERAL DRAINHOLES FROM A WELLBORE

FIELD OF THE INVENTION

The present invention relates to apparatus for drilling lateral drainholes from a wellbore. More particularly, drainholes are drilled using a bit driven by a flexible shaft formed of two or more concentric coil springs, having opposite pitch, guided through a short radius turning elbow anchored within the wellbore.

BACKGROUND OF THE INVENTION

After a well, completed into a formation, has been producing oil or gas over an extended period of time, the rate of production generally diminishes, often due to depletion of the reservoir or due to near-wellbore effects. Methods of alleviating diminished production can include treating the near-wellbore effects and increasing the drainage area or wellbore access. Treatment of near-wellbore effects include hot oil flushing to melt paraffins, high pressure fracturing, chemical treatments, or re-perforation of the casing and acidizing to open up additional flow passages. Each of these treatments are subject to restrictive use or success of short duration.

A more progressive solution is to increase the drainage area. This is generally accomplished by drilling holes laterally outwardly from the wellbore so as to increase communication with the formation. These holes are known as drainholes.

Typically, the hydrocarbon bearing portion of the formation is rather shallow. This delimits where the lateral drainholes are placed, requiring significant precision in vertical placement. Additionally, the drainholes must first pass through the existing casing and then extend into the formation.

Whipstock diversion or horizontal drilling techniques using mud motors account for most of the re-entry drilling techniques. Generally a full drilling rig is required and is used in combination with a whipstock to deviate the drill string. A portion of the casing is milled out and a rotary drilling string or mud motor essentially drills a new wellbore. This requires a large radius of turn which complicates targetting of the payzone. The process is expensive and results in a single new hole.

Lance-type penetrators, such as that disclosed in U.S. Pat. No. 5,392,858 to Peters, introduce apparatus to first mill through the casing and then provide a flexible conduit which supplies high pressure fluid to a nozzle. The nozzle jets forward while advancing, hydraulically cutting into the formation. Small radii (12") can successfully be achieved. Unfortunately, the high pressure fluid can erode the casing cement and re-establish undesirable cross-communication with vertically adjacent layers.

A lesser known technique is to provide a section of highly flexible drill shaft at the downhole end of a rotary shaft. These techniques use a single coiled spring as the power transmitting member with an internal or external elastomer sheath or hose to contain drilling fluids. These systems, as disclosed in U.S. Pat. Nos. 3,838,736 and 4,051,908 to Driver, have the following features in common: a tubing string is lowered into the casing, the string having a 90 degree elbow at its lower end; a flexible hollow shaft is connected to the lower end of drill pipe and is lowered down into the tubing string; the drill string is rotated, the flexible shaft is directed laterally by the elbow and proceeds to drill through the casing and into the formation. These and similar systems are limited to low drilling rotational speeds and low axial loading to avoid premature failure of the coil spring flexible shaft.

In the context of stabilizing the roofs of mines, a flexible drill shaft is used to drill holes upwardly into the roofs. By providing a flexible shaft, shaft lengths and thus hole depths greater than the height of the mine corridor can be achieved. As disclosed in U.S. Pat. No. 4,057,115 to Blanz, contra-wound bands or springs are used for the shaft. An outer band is helically wound about a coil spring having an opposite pitch. A drill bit is secured to the shaft's upper end. A rotary drive clamps onto the circumference of the outer band and applies torque. The drive and shaft are advanced axially upwardly, driving the bit into the mine's roof. When the rotary drive approaches the roof, it is unclamped, lowered axially and is re-clamped onto the shaft. During drilling, the outer band tends to contract, and the inner coil tends to expand, lending axial stability to the shaft.

This apparatus does not address the difficulties of downhole operation, including the ability and the need to introduce an axial load into the flexible shaft yet still make small radius turns, wherein the axial load originates before the turn is made.

SUMMARY OF THE INVENTION

Apparatus is provided or drilling drainholes laterally outwards from even very small diameter casings, enabling accurate and economical access to the hydrocarbon producing formation.

More particularly, apparatus is lowered down within the well's casing. The apparatus comprises a flexible shaft having a bit at the lower end and a shaft guide conduit. The "L" shaped guide conduit re-directs the shaft from a path parallel to the casing, to one substantially perpendicular to the casing. The shaft guide conduit is rigidly anchored within the casing. Accordingly, the bit is directed towards the casing, enabling cutting through the casing and into the formation. The flexible shaft has upper and lower ends and is formed of a helically wound outer coil spring and one or more helically wound and smaller inner coil springs residing concentrically therein. Each successively smaller inner coil spring has an outer diameter substantially the same as the inner diameter of the adjacent larger coil spring. Each coil spring is wound opposite in direction to that of the next adjacent coil spring. Each coil spring is held in rigid relation to each other coil spring at the shaft's upper and lower ends. The direction of the bit's rotation is coordinated with the direction of winding of the outer coil spring so that the diameter of the outer coil spring tightens upon the expanding diameter of the next adjacent inner coil spring. The "L" shaped shaft guide conduit has an upper straight portion and a lower elbow portion, the combined length of which is at least as long as the length of the shaft. Bushings are located within the lower elbow portion of the shaft guide conduit for causing the shaft to flex and turn while permitting rotation and axial movement therethrough. A motor is drivably connected to the top of the shaft and is movable up and down within the casing. Accordingly, when the motor is rotating the bit, and the shaft is lowered, the shaft guide conduit supports the shaft, guides it through the elbow portion and directs the bit against the casing for cutting through the casing and then into the formation.

Preferably, a driveshaft positioned between the motor and the shaft permits the shaft to pass through the shaft guide conduit without interference between the shaft guide conduit and the motor.

BRIEF DESCRPTION OF THE DRAWINGS

DETAILED DESCRIPTION OF THE PREFERRED EMBODIMENT

Figure 1:
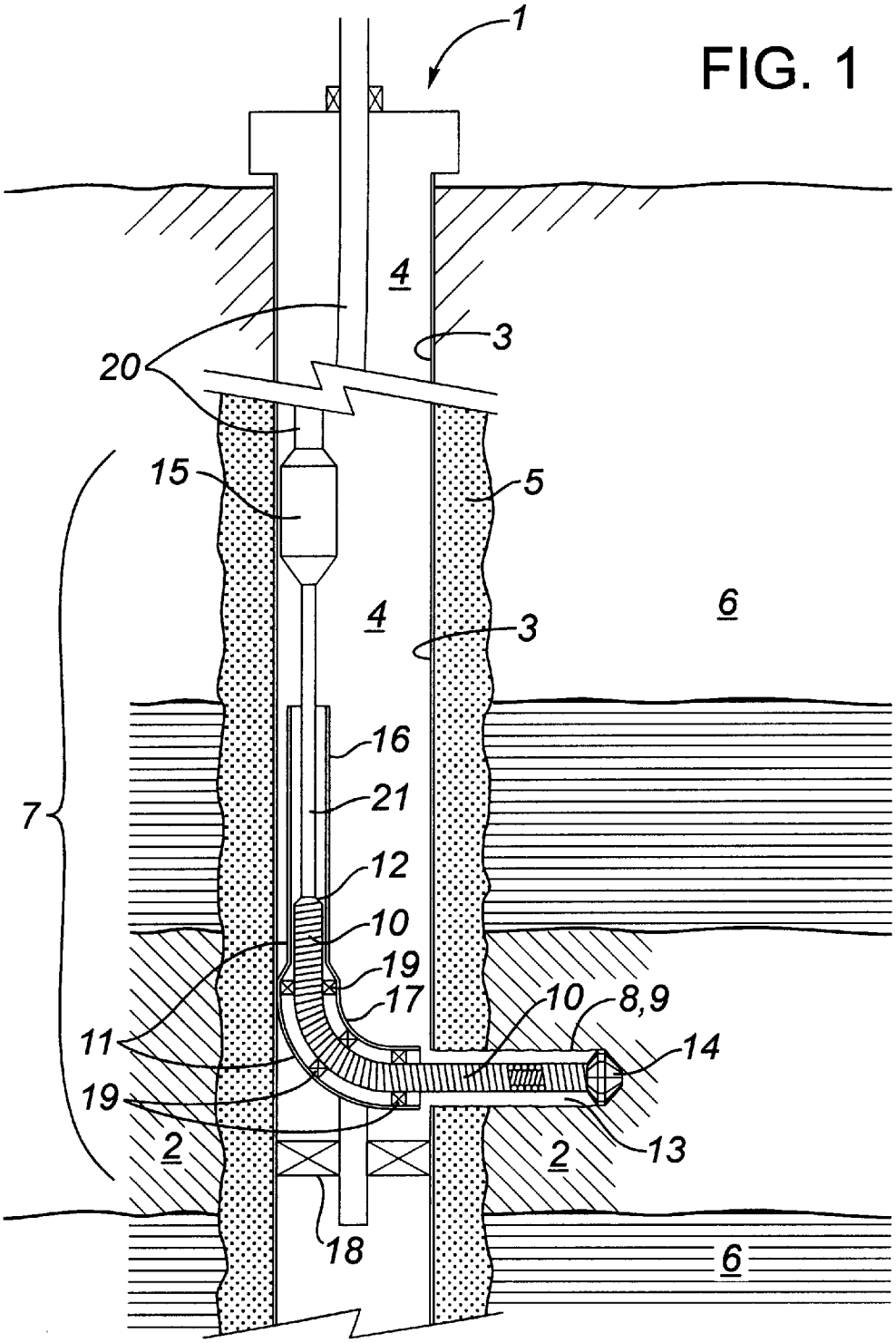
FIG. 1 is a cross-sectional view of a vertical wellbore with an embodiment of the present invention installed therein.

Referring to FIG. 1, a vertical well 1 is completed into a hydrocarbon-bearing formation, or producing zone 2. The well 1 comprises a casing 3 forming a wellbore 4. Cement 5 is placed about the casing 3. The cement 5, among other objects, prevents contaminating fluids from travelling along the casing 3, between the producing zone 2 and from other zones 6.

Whether the well 1 is new or existing, drainhole drilling apparatus 7 is lowered down the wellbore 4 to a location above the producing zone 2. The apparatus 7 enables drilling of one or more holes 8, each being substantially perpendicular to the wellbore, and each extending into the producing zone 2. The holes form laterally extending drainholes 9 which increase the drainage area of the well 1.

Generally, the apparatus 7 comprises a flexible shaft 10 extending through a shaft guide conduit 11. The shaft 10 has an upper end 12 and a lower end 13. A bit 14 is fitted to the shaft's lower end 13. The shaft guide conduit 11 acts to turn or guide the shaft 10 from a path which is parallel to the axis of the casing 3 to a path which is rotated substantially 90°, or is perpendicular to the casing's axis. A rotary drive means 15 such as an electric, hydraulic or mud motor enables rotation of the shaft 10 and the bit 14. Accordingly, for a vertical oriented casing 3, rotation of the shaft 10 about the vertical axis and turning of the shaft through the shaft guide conduit 11, will result in bit rotation and drilling about a horizontal axis.

The shaft 10 is movable up and down within the casing 3; down to enable drilling of the drainhole 9, and up to recover the bit 14 and shaft 10 from the drainhole 9.

More particularly, the shaft guide conduit 11 comprises a straight supporting portion or support conduit 16 at its upper end, and an elbow turning portion or turning elbow 17 at its lower end. The shaft 10 passes through the support conduit 16 and through the turning elbow 17. The turning elbow 17 turns the shaft 90 degrees. An anchor 18 is secured to the shaft guide conduit 11 and, when actuated, engages the casing 3 to hold the guide conduit 11 stationary within in the wellbore 4.

For drilling, the shaft's upper end 12 is subjected to downward load. The turning elbow 17 turns the downward load into a laterally directed load. To impart turning loads into the shaft, the turning elbow 17 has internal guide means or bearing surfaces 19 which act on the shaft and permit it to rotate under load while it advances therethrough. The bearing surfaces 19, preferably three hardwood or other bushings, are placed at the 0.45 and 90 degree positions within the turning elbow 17, thereby providing three points of contact between the turning elbow 17 and the shaft 10.

The motor 15 is suspended from the surface via tubing 20. The motor 15 and tubing 20 is movable up and down the casing 3. Typically, the motor 15 is too large to fit within the support conduit 11 and impairs up and down movement. Thus, a driveshaft 21 is connected between the motor 15 and the upper end 12 of shaft 10. The driveshaft 21 is smaller in diameter than is the motor 15. When the motor 15 is moved up and down within the casing 3, the driveshaft 21 moves up and down within the support conduit 16.

The length of the shaft 21 is greater in length than is the length of the desired drainhole 9. The support conduit 16 is at least the length of the shaft 10 for enabling lateral support of the flexible shaft throughout its drainhole drilling range. The driveshaft 21 is at least as long as the supporting conduit 16 so that the motor 15 does not contact the support conduit at the motor's lowest position.

Figure 3:
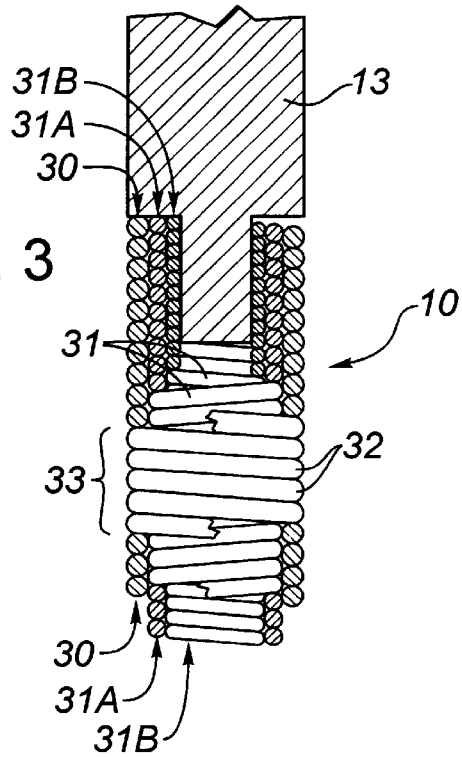
FIG. 3 is a partial side view of a flexible shaft having two inner coil springs installed concentrically within the outer coil spring.
Figure 2:
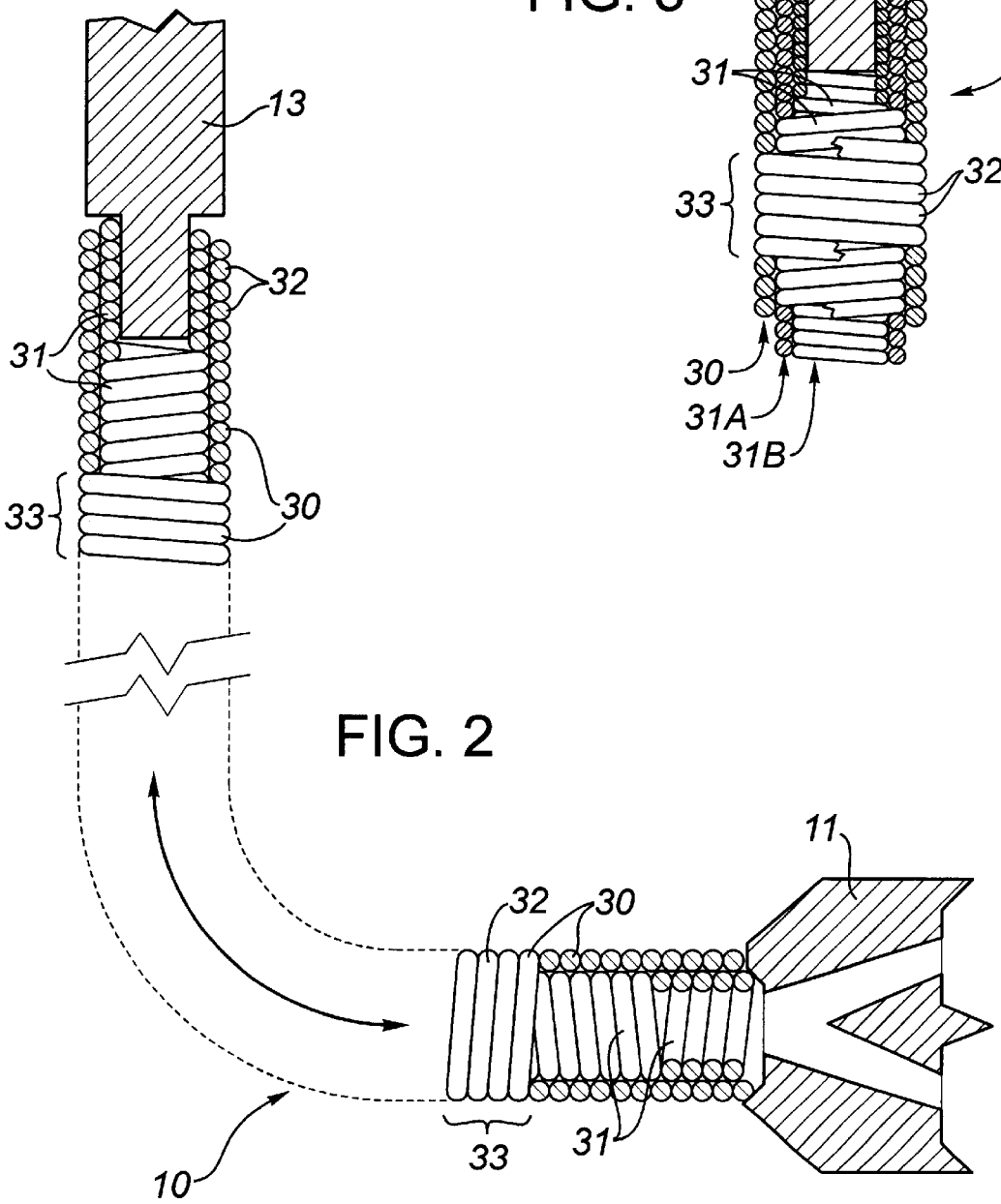
FIG. 2 is a side view of the flexible shaft of FIG. 1, with portions of the outer and inner coil springs cut away to illustrate both left and right windings of the coils.

Turning to the flexible shaft 10 in greater detail, and having reference to FIGS. 2 and 3, an assembly of concentric coil springs form a cylindrical, flexible shaft 10. More particularly, a helically wound outer coil 30 is formed of spring material, such as spring steel. One or more helically wound inner coil springs 31 reside concentrically within the outer coil spring 30. The inner coil spring or springs 31 are also formed of spring material. Use of a single inner coil spring is shown in FIG. 2 and the use of two inner coil springs 31*a*, 31*b* is shown in FIG. 3.

Each inner coiled spring 31 has an outer diameter which is substantially the same as the inner diameter of the next radially adjacent and larger coil spring, be it to the next larger inner coil spring (spring 31*b* to 31*a*) or to the outermost coil spring (spring 31 to 30). As shown, the cross-section of each coil 32 of each coil spring 30, 31 is circular. The periphery of the cross-section of axially adjacent coils 32 of each coil spring 30, 31 are in contact (close-wound).

The outer coil spring 30 and the inner coil spring or springs 31 are wound in opposite directions. Each successively smaller inner coil spring (30 to 31*a* to 31*b* . . . ) is wound opposite to the adjacent larger coil spring.

It is essential that the direction of winding of the outer coil spring 30 be coordinated with the direction of rotation of the flexible shaft 10. When subjected to torque, spring coils characteristically either shrink in diameter with a corresponding increase in length, or they expand in diameter and shorten in length. Accordingly, having chosen a direction of rotation of the bit 14, say clockwise ("CW") as viewed along the axis of the bit 14 towards the drilled subject (ie. the formation 2), the winding of the outer coil spring 30 is left handed ("LH"). In other words, when a coil spring is supported on a flat surface, with its axis lying parallel to the surface (ie. view FIGS. 2 and 3 rotated counterclockwise 90°), an individual coil of a LH coil spring angles downwardly to the left.

Accordingly, the outer coil spring 30 is formed with a LH winding and next adjacent inner coil spring 31 is formed with a right hand ("RH") winding. Under a CW drilling torque applied to the flexible shaft, the diameter of the outer coil spring 30 shrinks onto the next adjacent inner coil spring 31, whose diameter is correspondingly expanding. This action creates a strong and stable, yet flexible shaft 10.

At the shaft's upper end 12, the inner coil springs 31 and the outer coil spring 30 are held in rigid relation to each other. In other words the ends of inner and outer coil springs 31,30 are drivably interconnected to each other and are connected to the driveshaft 21 with means to prevent relative axial or rotary movement between first, the inner and outer springs 30,31 and secondly, to prevent rotary movement between the coil springs 30,31 and the driveshaft 21. These means include mechanical means, welding or brazing. Similarly, at the lower end 13 of the shaft 10, means drivebly interconnect the coil springs 30,31 and connect the coil springs 30,31 to the bit 14.

In operation, rotation imparted by the motor 15 is transmitted through the driveshaft 21 to the flexible shaft 10, causing the bit 14 to rotate. The motor 15 is raised and lowered in the wellbore 4 using tubing 20. To drill, the motor 15 and the driveshaft 21 are lowered in the casing 3. The descending, flexible shaft is supported laterally by the support conduit 16. The turning elbow 17 guides the shaft 10, directing the bit 14 laterally to bear against the casing 3. The bit 14 advances laterally, cutting materials encountered in its path including firstly the casing, and then the formation 2 itself to drill the drainhole 9.

During drilling, the outer diameter of the outer coil spring 30 forms a helical augering surface 33. During drilling, surface 33 augers drilled cuttings rearwardly along the outer coil spring and the drainhole until they fall into the bottom of the wellbore 4.

Interaction of the coil springs 30,31 and their flexing around the turning elbow 17 involves reversing stresses and friction at the bearing surfaces 19. For longest component life, lubrication is required. In a typical well, water or oil will be present at the bottom of the wellbore 4 and acts to lubricate and aid in heat dissipation.

After one drainhole 9 is drilled, the motor 15 is raised, retracting the flexible shaft 10 back into the turning elbow 17 and support conduit 16. Anchor 18 is then released, the assembly 7 is vertically adjusted, the anchor 18 is reset and another drainhole 9 is drilled.

The present invention was tested to validate the ability to drilling through a short turning radius elbow.

EXAMPLES

In bench scale testing, a flexible shaft was assembled using an outer coil spring 30 and one inner coil spring 31. The outer coil spring 30 had an outer diameter of $1\frac{15}{16}$ inches. Each coil of the outer coil spring 30 utilized a circular cross-section having a diameter of 0.203 inches. The outer coil spring 30 had a right hand pitch and adjacent coils were in contact (closed). The coil was formed of a chrome silicon, oil tempered spring steel.

One inner coil spring 31 was snugly fitted within the outer coil spring 30. One end was brazed to a shaft, the shaft being inserted into the chuck of an electric drill. The other end was brazed a conventional masonry bit having tungsten cutters.

Two tests were performed using the above flexible shaft, a ¾" masonry bit and a 9" turning radius elbow. In the first instance, using a ¼ HP motor and 500 rpm, a ¾ inch diameter hole was cut in 2000 psi concrete, about 2 inches deep in 120 seconds. In the second instance, using a ½ HP motor and 2000 rpm, a ¾ inch diameter hole was cut in 2000 psi concrete, about 2 inches deep in 30 seconds.

To demonstrate applicability to function within the bore of small diameter case, an elbow with a radius of less than 5 inches was prepared for installation within the bore of a 5 inch casing. The elbow was fitted with four hardwood bushings 21. To enable installation of the inner bushings the elbow was formed of two 45° steel elbows.

To simulate the supporting structure about the bore of a drainhole which would be formed between the elbow and the subsequent drilling location of the bit, a five foot section of 2 inch ID PVC pipe was installed after the elbow. Using a custom 2" diameter bit, having 4 tungsten carbide cutting faces, a 2 HP motor and 750 rpm, a 2 inch diameter hole was cut 2 inches deep in 60 seconds.

While the 2" diameter bit was originally pinned through its shank and through the two concentric coil springs, brazing was also used with equal success.

The present invention provided several advantages including:

- the ability to rework a well without a full rig and with a minimum of surface equipment;
- the whole tool assembly (motor elbow and shafting) is lightweight, typically only about 500 pounds; and
- fast workovers.

Various enhancements to the invention include:

- use of helically coils having cross-sectional profiles other than circular, for increased shear strength;
- coil material can be dictated to meet variable corrosion requirements, such as in sour wells;
- use of in-the-wellbore mud motor and tubing string, hydraulic or electric-powered motors and connecting cables or conceivably, a tubing string extending from the surface could be used to impart rotation into the flexible shaft, albeit at lower rotational speeds and high torque;
- vibratory or impact delivery means associated with the motor for enhanced drilling rates in the formation; or
- Use of a flexible conduit extending within the inner coil spring for delivering lubrication and cutting fluids to the bit.

The embodiments of the invention in which an exclusive property or privilege is claimed are defined as follows:

1. In a drilling apparatus comprising a flexible shaft directable down a wellbore extending downwardly into a subterranean formation, the flexible shaft having an upper driving end and a lower driven end, the flexible shaft being driven by a rotary drive and being axially movable in the wellbore for drilling therefrom, the improvement comprising:

- a helical outer coil spring and one or more smaller helical inner coil springs residing concentrically within the outer coil spring for forming the flexible shaft, each of the outer and inner coil springs being formed of wire having a substantially circular cross-section and each successively smaller inner coil spring having an outer diameter substantially the same as the inner diameter of the adjacent larger coil spring, each coil spring being wound opposite in direction to that of the next adjacent coil spring, and all coil springs being held in rigid relation to each other coil spring at the flexible shaft's driven and driving ends;
- a cutting bit at the driven end of the flexible shaft, the direction of the bit's rotation being co-ordinated with the outer coil spring so that torque causes the outer coil spring to tighten on the one or more inner coil springs;
- a shaft guide conduit forming an elbow having upper and lower ends through which the flexible shaft extends for diverting the flexible shaft from a path substantially parallel to the wellbore to one extending laterally;
- anti-friction means within the elbow for enabling the flexible shaft to move therethrough without restricting either rotation or axial movement therethrough; and
- an anchor for the shaft guide conduit within the wellbore.

2. The apparatus of claim 1, wherein the rotary drive introduces torque into the flexible shaft at the driving end, above the shaft guide conduit.

3. The apparatus of claim 2, wherein, during drilling, the flexible shaft is rotated at speeds of 500 rpm and greater.

4. The apparatus of claim 3, wherein, during drilling, the bit drills a drainhole and forms cuttings, the apparatus further comprising a helical auguring surface formed by the outer coil spring so that cuttings are augured away from the bit and through the drainhole to the wellbore.

5. The apparatus of claim 4, wherein the wire of the outer coil spring and one or more inner coil springs is formed of oil tempered spring steel.

6. The apparatus of claim 5, where the wellbore is cased, and the cutting bit is capable of drilling through metal casing so that the bit drills first through the casing and then drills a drainhole in the formation.

7. The apparatus of claim 5, wherein the anti-friction means comprises three or more bearings fitted and distributed between the upper and lower ends of the elbow.

8. The apparatus of claim 9, wherein the bearings are bushings.

9. The apparatus of claims 5, wherein the shaft guide conduit and anchor co-operate to anchor position the elbow eccentrically within the wellbore so that the size of the elbow is maximized for the size of the wellbore.

10. The apparatus of claim 9, wherein the bit is sized to fit within the elbow and the bearing adjacent the lower end of the elbow is inset from the lower end so that during installation in the wellbore, the bit can be recessed at least partially within the elbow.

11. The apparatus of claim 10, further comprising a straight conduit at the shaft guide conduit's upper end for guiding the flexible shaft into the elbow, the length of the straight conduit being about the same length of the shaft.

12. The apparatus of claim 11, further comprising a driveshaft connected between the rotary drive and the driving end of the flexible shaft for transmitting rotational and axial loads therebetween, the length of the driveshaft being at least as long as the straight conduit.

13. The apparatus of claim 5, wherein the flexible shaft is subjected to axial vibration for enhancing drilling rates in the formation.

14. The apparatus of claim 2, wherein the flexible shaft is capable of rotation at speeds of 500 rpm and greater during drilling.

* * * * *

UNITED STATES PATENT AND TRADEMARK OFFICE

CERTIFICATE OF CORRECTION

PATENT NO. : 6,220,372 B1
APPLICATION NO. : 08/985085
DATED : April 24, 2001
INVENTOR(S) : Donald Earl Cherry It is certified that error appears in the above-identified patent and that said Letters Patent is hereby corrected as shown below:

Column 7, line 16, reads "of claims 5," should read -- of claim 5, --

Signed and Sealed this

Twenty-first Day of August, 2007

JON W. DUDAS
*Director of the United States Patent and Trademark Office*